US007987864B1

(12) United States Patent
Jackson

(10) Patent No.: US 7,987,864 B1
(45) Date of Patent: Aug. 2, 2011

(54) DEPLOYABLE STRUCTURES AND METHODS FOR ASSEMBLING SAME

(76) Inventor: Harrison Joshua Jackson, Pittsburgh, PA (US)

( * ) Notice: Subject to any disclaimer, the term of this patent is extended or adjusted under 35 U.S.C. 154(b) by 23 days.

(21) Appl. No.: 12/475,342

(22) Filed: May 29, 2009

(51) Int. Cl.
*E04H 15/44* (2006.01)
*E04B 1/32* (2006.01)

(52) U.S. Cl. ..... 135/123; 135/128; 135/905; 52/81.3; 52/646

(58) Field of Classification Search ..... 135/123, 135/125, 127, 128, 120.3–120.4, 115, 119, 135/905, 907; 52/81.2–81.3, 108, 641, 644–646, 52/83, 79.5, 652.1; 273/156, 159
See application file for complete search history.

(56) References Cited

U.S. PATENT DOCUMENTS 1,773,847 A 8/1930 Nickles
3,502,091 A * 3/1970 Corbin ..... 135/97
3,941,140 A 3/1976 Beavers
4,078,572 A 3/1978 Moss
D261,407 S 10/1981 Moss
4,393,887 A 7/1983 Orobin
4,494,558 A 1/1985 Fidler, Jr.
4,569,362 A 2/1986 Fidler, Jr.
4,706,696 A * 11/1987 Gillis ..... 135/127
4,731,962 A * 3/1988 Kittner et al. ..... 52/81.2
4,944,322 A * 7/1990 Gillis ..... 135/153
4,974,621 A 12/1990 Lerma
4,998,552 A * 3/1991 Niksic et al. ..... 135/136
5,080,119 A 1/1992 Scherer
5,117,852 A 6/1992 Bryant
5,159,948 A 11/1992 Moreau et al.
5,301,705 A 4/1994 Zheng
5,361,794 A * 11/1994 Brady ..... 135/147
5,411,047 A * 5/1995 Reilly ..... 135/127
5,439,018 A 8/1995 Tsai
5,458,146 A 10/1995 Gregg
D370,046 S 5/1996 Eppenbach
5,573,027 A 11/1996 Hsiung
D378,118 S * 2/1997 Lah ..... D21/838
D396,086 S 7/1998 Cantwell
5,884,646 A 3/1999 Ju
5,944,040 A 8/1999 Jang
6,021,795 A 2/2000 Long et al.
6,021,796 A 2/2000 Vavra
6,173,726 B1 1/2001 Talmadge
6,216,717 B1 4/2001 Chen
D457,590 S 5/2002 Olson et al.
D470,907 S 2/2003 Ju
6,598,614 B2 7/2003 Liu
6,725,873 B2 4/2004 Liu
6,772,883 B2 8/2004 Lindamood
(Continued)

*Primary Examiner* — Winnie Yip
(74) *Attorney, Agent, or Firm* — Thorp Reed & Armstrong, LLP

(57) ABSTRACT

Deployable structures and methods for assembling the same including a structural mechanism defining a columnar space comprising a plurality of structural members, a plurality of couplings and a plurality of tension lines, wherein each of the couplings interconnects three of the structural members and each of the tension lines interconnects one of the couplings and one of the structural members. Each of the tension lines interconnects one of the couplings and an end of one of the structural members not interconnected with one of the couplings. A columnar space, devoid of any structural members, is centrally located within the structural mechanism. Each of the couplings interconnects two of three structural members such that they are substantially aligned along their respective longitudinal axes and the third of the three structural members is interconnected such that its longitudinal axis is substantially perpendicular to the longitudinal axes of the other two structural members.

19 Claims, 6 Drawing Sheets

U.S. PATENT DOCUMENTS

| | | | | |
|---|---|---|---|---|
| 6,843,261 | B2 | 1/2005 | Gillis | |
| 6,892,744 | B2 | 5/2005 | Feldspausch et al. | |
| 6,904,924 | B2 | 6/2005 | Warner | |
| 6,923,195 | B2 | 8/2005 | Tseng | |
| 6,941,704 | B2 | 9/2005 | Chen et al. | |
| 7,004,183 | B2 | 2/2006 | Gillis | |
| 7,137,399 | B1 | 11/2006 | Ransom et al. | |
| 7,140,377 | B1 | 11/2006 | Dahulich | |
| 7,150,052 | B1 | 12/2006 | Lawson et al. | |
| 7,152,614 | B2 | 12/2006 | Kalnay | |
| 7,159,601 | B2 | 1/2007 | Zheng | |
| D536,761 | S | 2/2007 | Wehner | |
| 7,290,553 | B2 | 11/2007 | Prevost | |
| 7,578,307 | B2 * | 8/2009 | Ung et al. | 135/128 |
| 7,766,023 | B2 * | 8/2010 | Scherer | 135/126 |

* cited by examiner

DEPLOYABLE STRUCTURES AND METHODS FOR ASSEMBLING SAME

BACKGROUND OF THE INVENTION

1. Field of the Invention

The present invention relates to deployable structures which include a structural mechanism which is movable for deployment of the structure. The deployable structures of the present invention may be used as structures in a wide range of applications ranging from small structures to large ones. They are particularly, but not exclusively, applicable as frames for tent-like structures.

2. Description of the Related Art

Portable enclosures, such as tents, have been used as blinds and shelters for centuries. The structure and appearance of such enclosures vary greatly.

More recently, easily portable, lightweight, durable and affordable enclosures have become a desirable accessory for many outdoor recreational activities, including camping and hunting. The widespread availability of modern lightweight structures and fabrics has resulted in the proliferation of literally hundreds of new designs for portable enclosures. Among the many popular current styles for tents and hunting blinds are the so-called "collapsible" structures which utilize a spring-like framework which can be easily collapsed and folded for transportation and storage. Such popular designs are typified in, for example, U.S. Pat. Nos. 6,843,261 to Gillis, 6,941,704 to Chen et al., 7,004,183 to Gillis and 7,137,399 to Ransom et al.

These types of enclosures are inexpensive, lightweight, and convenient to use. However, one drawback in structures of this type is the lack of sufficient head room via an open, central columnar space devoid of any structural members. Known designs invariably employ overhead structural members to support the top covering material against sagging or deformation in the roof or top portion of the enclosure. It is desirable, therefore, to improve the structural integrity of existing collapsible structures by inclusion of lightweight and resilient deployable structures that can be easily stowed, transported and deployed, with a minimum of difficulty, and that are easily adapted to cause the roof or upper portion of an outer covering to conform to a particular profile without the use of structural members disposed in a central space of the structure.

SUMMARY OF THE INVENTION

In a first aspect, the present invention comprises a deployable structure including a structural mechanism defining a columnar space comprising a plurality of structural members, a plurality of couplings and a plurality of tension lines, wherein each of the couplings interconnects three of the structural members and each of the tension lines interconnects one of the couplings and one of the structural members. Preferably each of the tension lines interconnects one of the couplings and an end of one of the structural members not interconnected with one of the couplings. Also, the columnar space is preferably centrally located within the structural mechanism and is devoid of any structural members.

In another aspect of the present invention, in the deployed structural mechanism each of the couplings preferably interconnects two of the three structural members such that they are substantially aligned along their respective longitudinal axes and the third of the three structural members is interconnected such that its longitudinal axis is substantially perpendicular to the longitudinal axes of the two structural members.

In accordance with yet another aspect of the present invention, each of the couplings comprises a tube having first and second open ends wherein each of the first and second open ends receives an end of one of the two of the three structural members to interconnect the two structural members such that they are substantially aligned along their respective longitudinal axes when the deployable structure is deployed. Further, an elastic cord may be secured to each of the ends of the structural members received within the coupling. Additionally, each of the couplings may further comprise a stop member disposed within the tube between the first and second open ends to stop each of the ends of the structural members from traveling completely through the coupling and wherein the elastic cord passes through or around the stop member.

In a further aspect of the present invention, in a stowed condition, each of the couplings of the structural mechanism interconnects three of the structural members.

In another aspect of the present invention, in a stowed condition of the structural mechanism, the two of the three structural members are no longer interconnected such that they are substantially aligned along their respective longitudinal axes.

In a further aspect of the present invention, each of the structural members preferably comprises a material selected from the group consisting of: plastic, PVC tubing, wood, and graphite composite. Furthermore, each of the couplings may preferably be made integral with at least one of the structural members.

In accordance with yet another aspect of the present invention, each of the couplings preferably comprises a hinge which allows the structural mechanism to be converted from a deployed condition to a stowed condition and vice versa.

In another aspect of the present invention, the deployable structure preferably comprises one or more tie lines, wherein each of the tie lines is disposed between one of the couplings and one of the structural members when the structural mechanism is deployed.

In a further aspect of the present invention, the deployable structure is a tent and further comprises an outer covering acting as one or more components selected from the group consisting of: a roof, a floor, a side barrier and a wall. Further, the tension lines preferably are an integral part of the outer covering. Additionally, the deployable tent structure may further comprise one or more tie lines, wherein each of the tie lines is disposed between one of the couplings and one of the structural members when the structural mechanism is deployed and wherein the tension lines and the tie lines are an integral part of the outer covering.

In accordance with yet another aspect of the present invention, the deployable structure preferably is a container and may further comprise an outer covering acting as one or more components selected from the group consisting of: a lid, a bottom, a side barrier and a wall. Additionally, the lid may preferably be removable and the tension lines preferably are an integral part of the outer covering. Further, the deployable container structure may preferably further comprise one or more tie lines, wherein each of the tie lines is disposed between one of the couplings and one of the structural members when the structural mechanism is deployed and wherein the tension lines and the tie lines are an integral part of the outer covering.

In a further aspect, the present invention preferably comprises a method for assembling a deployable structure, comprising: assembling a first subassembly comprising a first coupling removably interconnecting first and second structural members, a second coupling removably interconnecting third and fourth structural members, a first tension line removably attached to each of the first and third structural members, and a second tension line removably attached to each of the second and fourth structural members; assembling a second subassembly comprising a third coupling removably interconnecting fifth and sixth structural members, a fourth coupling removably interconnecting seventh and eighth structural members, a third tension line removably attached to each of the fifth and seventh structural members, and a fourth tension line removably attached to each of the sixth and eighth structural members; assembling a third subassembly comprising a fifth coupling removably interconnecting ninth and tenth structural members, a sixth coupling removably interconnecting eleventh and twelfth structural members, a fifth tension line removably attached to each of the ninth and eleventh structural members, and a sixth tension line removably attached to each of the tenth and twelfth structural members; detaching the fifth tension line from the eleventh structural member; removably attaching each of the fifth tension line and the eleventh structural member to the first coupling; detaching the first tension line from the third structural member; removably attaching each of the first tension line and the third structural member to the third coupling; detaching the third tension line from the seventh structural member; removably attaching each of the third tension line and the seventh structural member to the fifth coupling; detaching the sixth tension line from the tenth structural member; removably attaching each of the sixth tension line and the tenth structural member to the second coupling; detaching the second tension line from the second structural member; removably attaching each of the second tension line and the second structural member to the fourth coupling; detaching the fourth tension line from the sixth structural member; and removably attaching each of the fourth tension line and the sixth structural member to the sixth coupling.

In another aspect of the present invention, a deployable structure preferably comprises a plurality of couplings, a plurality of structural members and a plurality of tension lines wherein three of the structural members and one of the tension lines is removably attached to each of the couplings. In a further aspect of the present invention, the deployable structure preferably comprises six couplings, twelve structural members and six tension lines wherein three of the structural members and one of the tension lines is removably attached to each of the couplings. Further, first, second and eleventh of the twelve structural members and a fifth of the six tension lines preferably are removably attached to a first of the six couplings; third, fourth and tenth of the twelve structural members and a sixth of the six tension lines preferably are removably attached to a second of the six couplings; third, fifth and sixth of the twelve structural members and a first of the six tension lines preferably are removably attached to a third of the six couplings; second, seventh and eighth of the twelve structural members and a second of the six tension lines preferably are removably attached to a fourth of the six couplings; seventh, ninth and tenth of the twelve structural members and a third of the six tension lines preferably are removably attached to a fifth of the six couplings; and sixth, eleventh and twelfth of the twelve structural members and a fourth of the six tension lines preferably are removably attached to a sixth of the six couplings.

BRIEF DESCRIPTION OF THE DRAWINGS

The above and other advantages of the present invention will become apparent from the following description when read in conjunction with the accompanying drawings wherein.

DETAILED DESCRIPTION OF THE PREFERRED EMBODIMENTS

The foregoing is to be construed as only being an illustrative embodiment of this invention. Persons skilled in the art can easily conceive of alternative arrangements providing functionality similar to this embodiment without any deviation from the fundamental principles or the scope of this invention.

Figure 1:
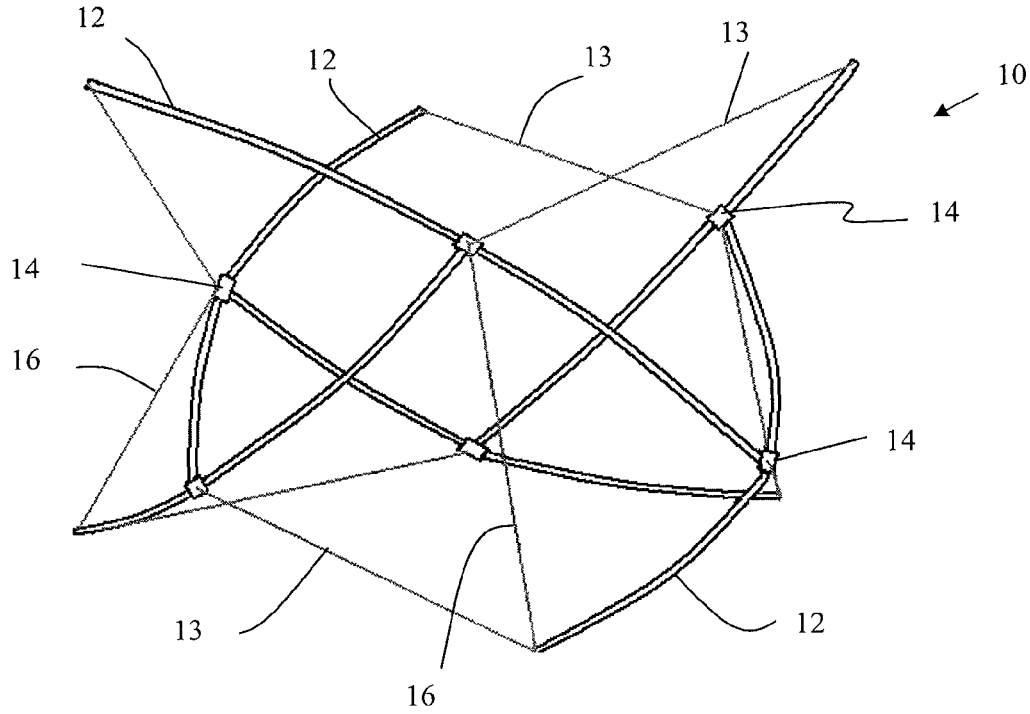
FIG. 1 is a side elevational view of a preferred embodiment of a deployable structure of the present invention.
Figure 2:
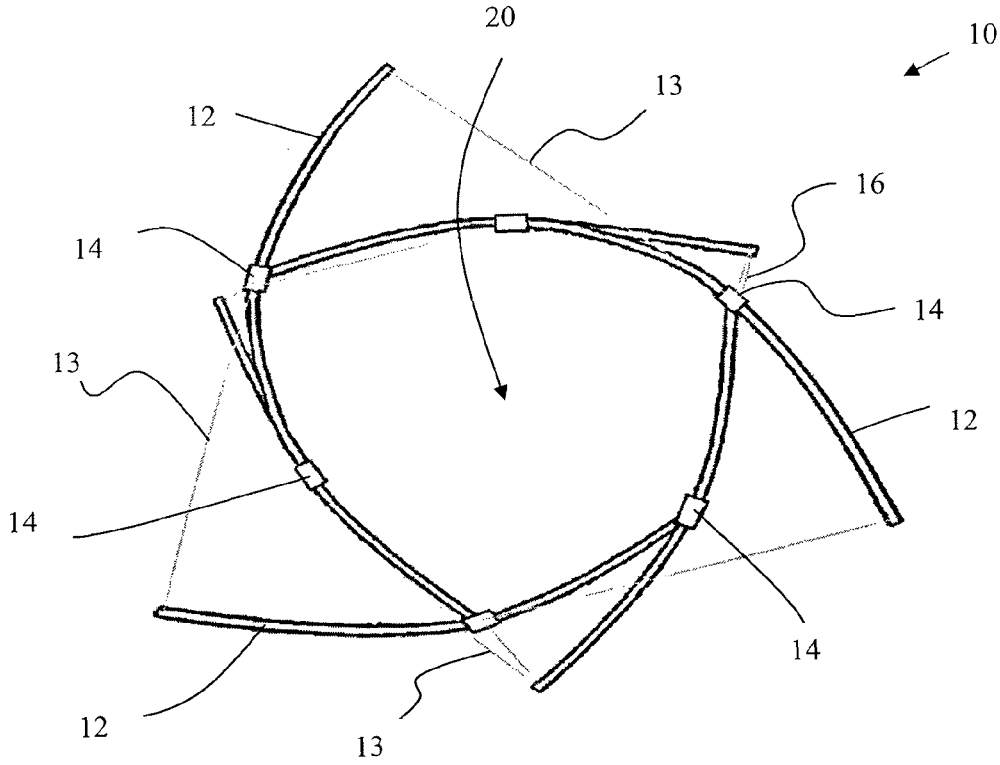
FIG. 2 is a top plan view of a preferred embodiment of a deployable structure of the present invention.
Figure 3:
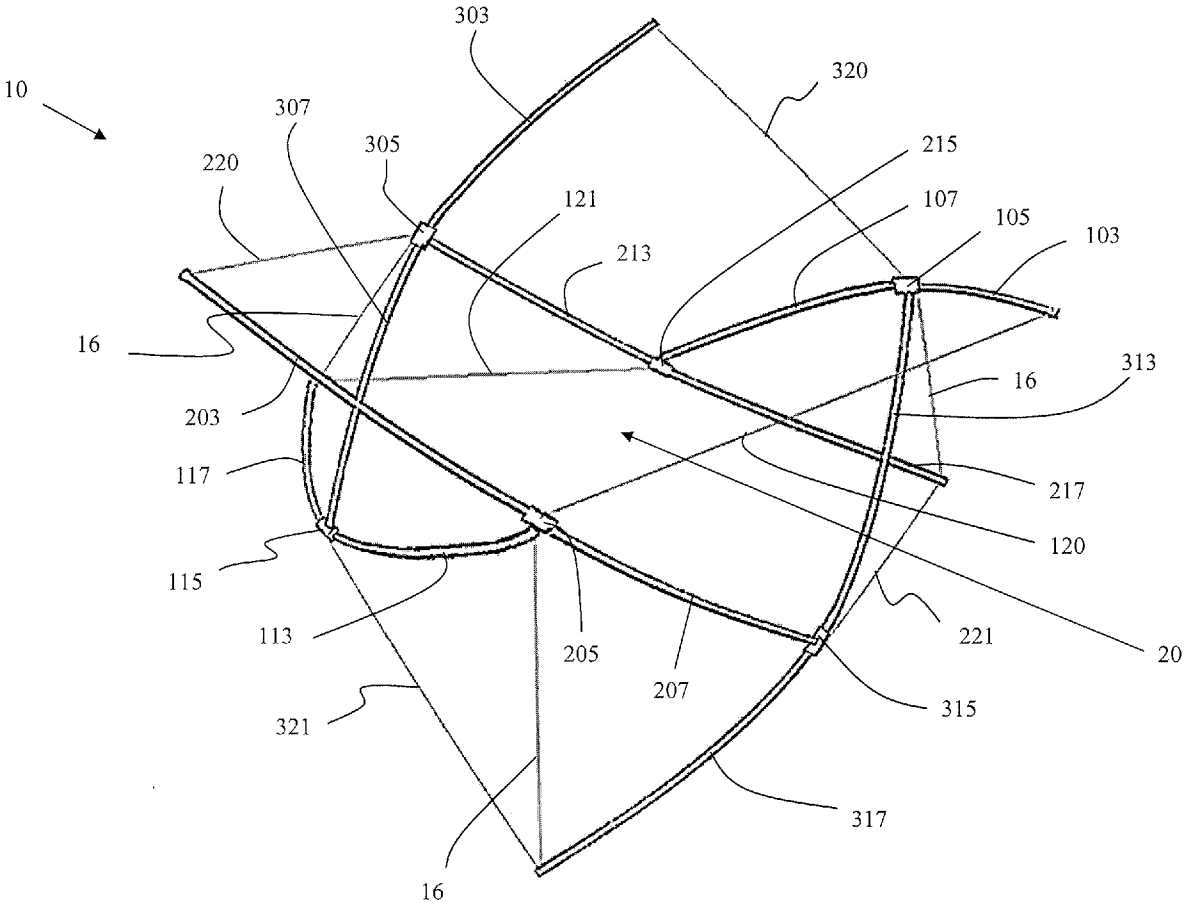
FIG. 3 is a perspective view of a preferred embodiment of a deployable structure of the present invention.

Referring to FIG. 1, a preferred embodiment of a deployable structure 10 according to the present invention comprises a plurality of structural members 12 interconnected via a plurality of tension lines 13, couplings 14 and tie lines 16. Deployable structure 10 is a collapsible, unitary design structure ideal for tents, but may also be scaled into smaller versions suitable for, but not limited to, clothes racks, hampers, toys, etc. Preferably, as shown in FIGS. 1-3, deployable structure 10 defines a central columnar space 20 in which no structural members 12, tension lines 13, couplings 14 or tie lines 16 are disposed. Rigidity and structural support of deployable structure 10 is derived from the preferred construction of the interconnected structural members 12 that exerts positive tension away from the open central space 20.

As shown in FIGS. 1-3, structural members 12 are joined axially in pairs by couplings 14. The couplings 14 provide at least two known benefits. One, the couplings 14 maintain axial relativity between two structural members 12. Two, the couplings 14 provide an anchor for attaching another structural member 12, non-axially, as well as providing an anchor for attaching a tension line 13.

As shown in FIGS. 1-3, deployable structure 10 preferably defines a central columnar space 20 having a generally triangular cross-section as outlined by the terminating ends of the structural members 12 at the top and bottom of the deployable structure 10. Structural members 12 extend in a helical pattern from the triangular base and ceiling. As shown in FIG. 2, the base and ceiling are equal in size and rotated 60° on center from each other. While rotational symmetry in the deployable structure may be present, it is not necessary.

Referring to FIGS. 1-3, preferably tie lines 16 are removably attached between structural members 12 and couplings 14 to exert additional positive tension away from the open central space 20, adding to structure stability of deployable structure 10. Tie lines 16 also serve to "lock" deployable structure 10 in its open or deployed position shown in FIG. 3. To close deployable structure 10, tie lines 16 are disengaged at one end, while the other end of each tie line 16 may remain attached to the deployable structure 10. The number and location of tie lines 16 can be varied to optimize the stability of deployable structure 10. In certain embodiments of the deployable structure 10 of the present invention, tie lines 16 may not be necessary.

Figure 4:
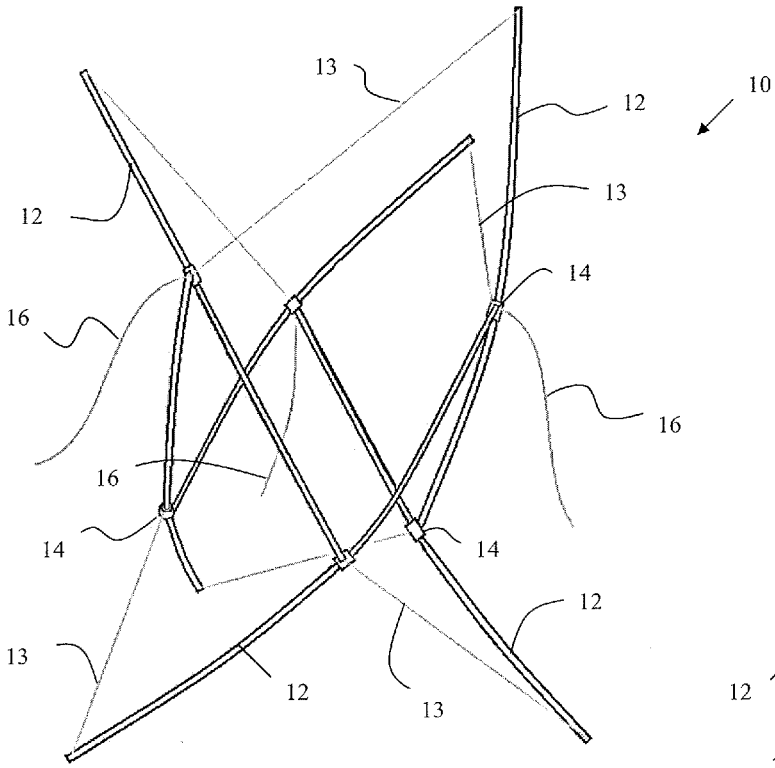
FIG. 4 is a perspective view of a preferred embodiment of a deployable structure of the present invention in a partially stowed condition.
Figure 5:
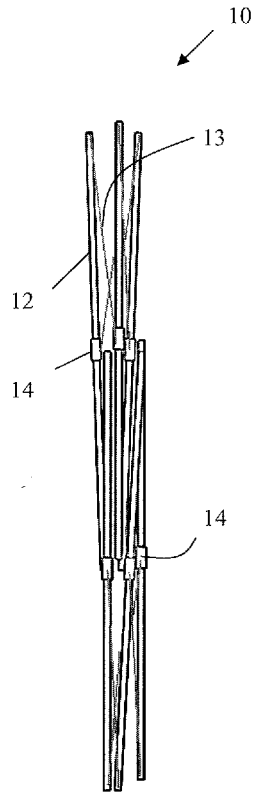
FIG. 5 is a side view of a preferred embodiment of a deployable structure of the present invention in a partially stowed condition.
Figure 6:
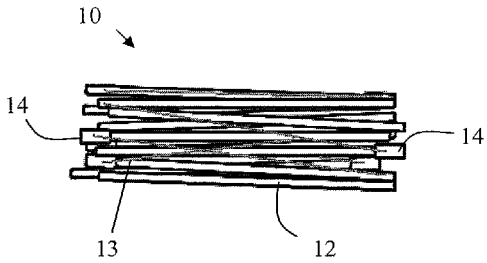
FIG. 6 is a side view of a preferred embodiment of a deployable structure of the present invention in a fully stowed condition.

FIGS. 4-6 show the deployable structure 10 in progressively closed positions with FIG. 4 showing a partially open state, FIG. 5 showing an intermediate closed state and FIG. 6 a fully stowed condition of deployable structure 10. The stowing of deployable structure 10 is accomplished by first disengaging any attached tie lines 16 to produce the condition shown in FIG. 4. Next, deployable structure 10 is propped up to the compact configuration shown in FIG. 5. The partially stowed condition of FIG. 5 is obtained by relaxation of structural members 12, which are in tension in the open position. Lastly, axially mated pairs of structural members 12 are folded or disengaged at the coupling 14 resulting in the fully stowed configuration shown in FIG. 6. Conversely, opening deployable structure 10 is accomplished by the reverse procedure. Structural members 12 are extended and inserted in couplings 14, or where hinge-type couplings are used, they are unfolded. Next, the structural members 12 are pulled apart from each other and tie lines 16 are secured, if used.

Figure 7:
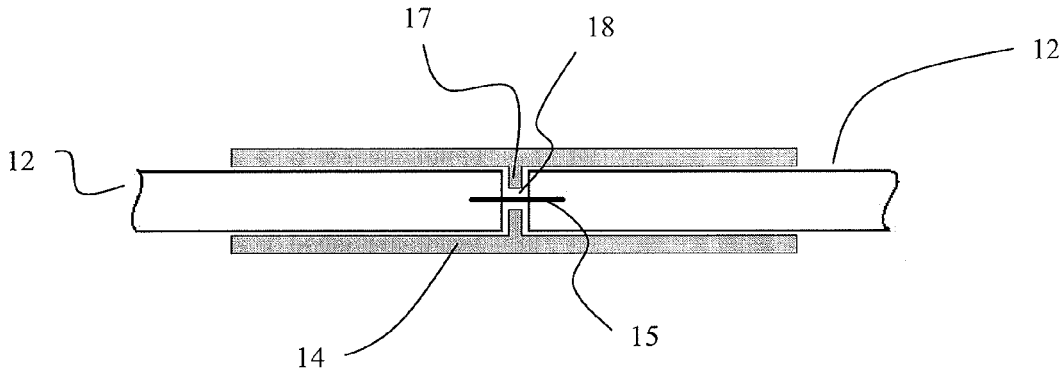
FIG. 7 is a longitudinal cross-section view of a preferred embodiment of a coupling for use in constructing a preferred embodiment of a deployable structure of the present invention.

In a preferred embodiment, FIG. 7 shows a cutaway view of a coupling 14 with two structural members 12 interconnected or joined using coupling 14 by elastic cord 15, similar to typical tent pole configurations that fold. The elastic cord 15 is tied or otherwise attached to the end of each structural member 12 inserted into coupling 14 and abutting against stop 17 which defines an opening 18 to allow elastic cord 15 to pass through. The stop 17 prevents each structural member 12 from completely passing through the coupling 14, but allows the elastic cord 15 to pass through. Couplings 14 preferably are made from metal, plastic, composite or some other material of sufficient rigidity to maintain the substantially axial relationship between the two structural members 12 interconnected thereby. Further, couplings 14 may be made integrally with one or more structural members 12. Couplings 14 also may comprise a rigid hook or loop (not shown) or some other mechanism for providing one or more points for attaching tension lines 13, tie lines 16 or another structural member 12 in a non-axial relationship. Such points of attachment do not need to be disposed on the couplings 14, but may also be located on one or more structural members 12 near a coupling 14. In addition, couplings 14 may comprise a locking elbow mechanism, similar to a door hinge. This would lock mating structural members 12 in the open structure position but allow the structural members 12 to fold about an axis centered on the elbow where a coupling 14 would normally provide a point of folding.

Figures 8, 9, 10:
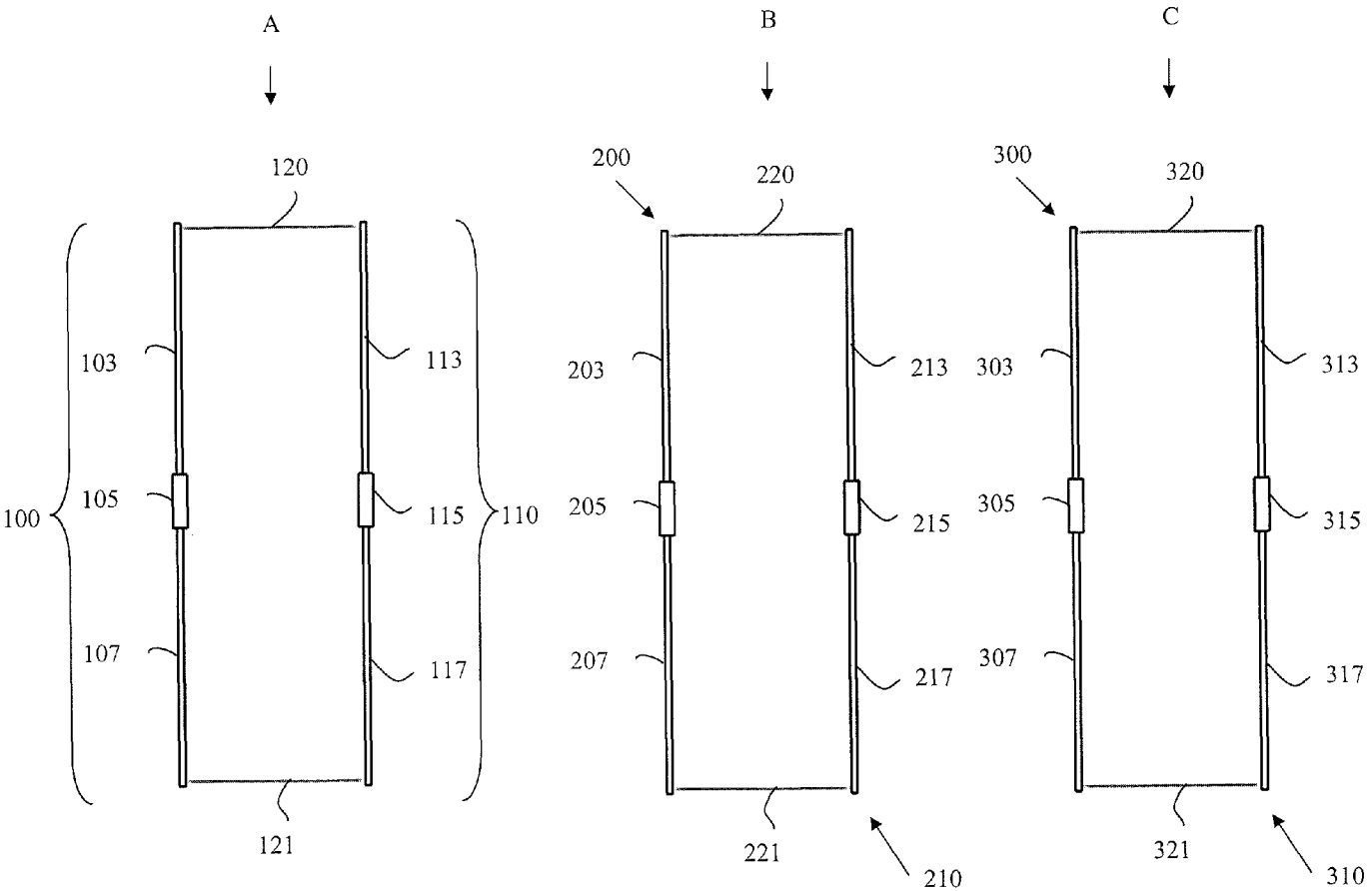
FIG. 8 is a top plan view of a preferred embodiment of a first of three subassemblies for use in constructing a preferred embodiment of a deployable structure of the present invention.
FIG. 9 is a top plan view of a preferred embodiment of a second of three subassemblies for use in constructing a preferred embodiment of a deployable structure of the present invention.
FIG. 10 is a top plan view of a preferred embodiment of a third of three subassemblies for use in constructing a preferred embodiment of a deployable structure of the present invention.

Structural members 12 preferably are flexible in nature, may be solid or hollow and may comprise one or more materials including plastic, aluminum, steel or other metals, PVC tubing, wood, and graphite composite, similar to typical tent poles. Structural members 12 may also be tapered or otherwise contain non-uniform cross-sectional profiles along their lengths. Choice of material and dimensions for structural members 12 may vary to optimize strength, rigidity, weight, etc. As shown in the drawings, structural members 12 preferably are equal in length, cross-section, and hollow to accommodate an internal elastic cord 15. Further, two structural members 12 connected by a coupling 14 jointly represent one arm, for example, arm 100 or arm 110, of the structure, as shown in FIG. 8. By this design, arm 100 or arm 110 preferably can be folded or uncoupled at the coupling 14. Other variations of the arm design of the present invention, for example, arm 100 or arm 110, may include greater or fewer structural members 12, couplings 14, and/or cords 15 to increase or reduce folding capabilities. An arm 100 or 110 may also be represented by a telescoping arrangement of structural members 12 and/or couplings 14, as one alternative to the preferred embodiments of the present invention shown in the drawings.

Tension lines 13 and tie lines 16 may be any conventional string, cord, polyurethane line, etc., that can adequately withstand the tension forces generated by the structural members 12. Tension lines 13 and tie lines 16 may also be made integral with a structure covering, if used. This may include a tent roof, wall, and/or floor coverings, as applicable. Further, in the mode shown, the terminating end of a tension line 13 at a coupling 14 is also used to affix one non-axial structural member 12 to the coupling 14. This is accomplished by tying the structural member 12 to the coupling 14 through holes (not shown) in both respective parts. Alternative methods for affixing tension lines 13, couplings 14, and structural members 12 may include clasps, hooks, bolts, etc. Tie lines 16 may also be attached in this manner to structural members 12 and couplings 14 or by tying.

Another feature of the present invention is that structure 10 preferably is free-standing and does not necessitate guy-lines. However, guy-lines and/or stakes may be added, particularly when structure 10 is used for a tent or other type of shelter.

Referring now to FIGS. 8-10, preferred subassemblies and methods of constructing a deployable structure according to the present invention are described. Subassembly "A" of FIG. 8 preferably comprises first and second arms 100 and 110 temporarily interconnected by tension lines 120 and 121 to facilitate final assembly of the deployable structure 10. First arm 100 of subassembly "A" preferably comprises structural members 103 and 107 removably or hingedly interconnected by coupling 105. Second arm 110 of subassembly "A" preferably comprises structural members 113 and 117 removably or hingedly interconnected by coupling 115.

Subassembly "B" of FIG. 9 preferably comprises first and second arms 200 and 210 temporarily interconnected by tension lines 220 and 221 to facilitate final assembly of the deployable structure 10. First arm 200 of subassembly "B" preferably comprises structural members 203 and 207 removably or hingedly interconnected by coupling 205. Second arm 210 of subassembly "B" preferably comprises structural members 213 and 217 removably or hingedly interconnected by coupling 215.

Subassembly "C" of FIG. 10 preferably comprises first and second arms 300 and 310 temporarily interconnected by tension lines 320 and 321 to facilitate final assembly of the deployable structure 10. First arm 300 of subassembly "C" preferably comprises structural members 303 and 307 removably or hingedly interconnected by coupling 305. Second arm 310 of subassembly "C" preferably comprises structural members 313 and 317 removably or hingedly interconnected by coupling 315.

In a preferred method of assembling structural mechanism of the deployable structure 10 of FIG. 3, subassemblies A, B and C are finally assembled according to the following:

Coupling 105 interconnects with structural members 103, 107 and 313 as well as tension line 320;

Coupling 205 interconnects with structural members 203, 207 and 113 as well as tension line 120;

Coupling 305 interconnects with structural members 303, 307 and 213 as well as tension line 220;

Coupling 115 interconnects with structural members 113, 117 and 307 as well as tension line 321;

Coupling 215 interconnects with structural members 213, 217 and 107 as well as tension line 121; and Coupling 315 interconnects with structural members 313, 317 and 207 as well as tension line 221.

Figure 11:
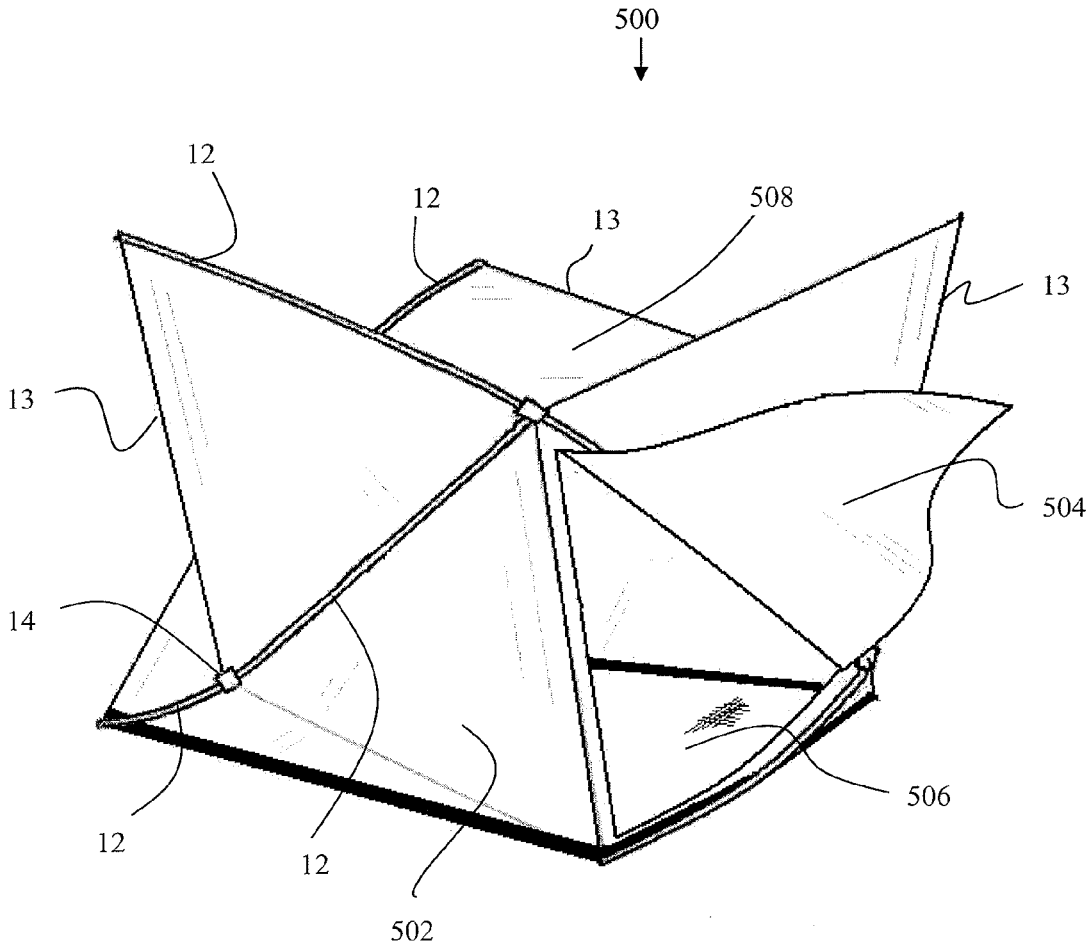
FIG. 11 is a perspective view of a preferred embodiment of a deployable structure of the present invention comprising an outer covering.

Referring now to FIG. 11, a preferred embodiment of the deployable structure of the present invention having an outer covering is described. Deployable structure 500 of FIG. 11 preferably comprises structural members 12, couplings 14, tension lines 13, as well as tie lines 16 (not shown) as described above, covered by covering 502. Each or a portion of each of the covering 502, flap 504, flooring material 506 and/or roof material 508 may comprise one or more wind-resistant, water-resistant and/or breathable materials such as nylon, plastic, canvas, polyester, polyurethane, polyethylene, polytetrafluoroethylene materials such as Gore-Tex® brand materials available from W.L. Gore & Associates, Inc., Newark, Del., and/or MemBrain® brand fabrics by Marmot Mountain Ltd., Santa Rosa, Calif., etc. A flap 504, with or without a zipper, Velcro or other suitable closure mechanism (not shown), may be defined by covering 502 for providing access to and from the interior of deployable structure 500 which may also comprise a flooring material 506 and roof material 508 as part of the covering 502. Flooring material 506 and roof material 508 may be integrally formed as part of the covering 502 or they may be detachable therefrom. Each or a portion of each of the covering 502, flap 504, flooring material 506 and/or roof material 508 may comprise an opaque, translucent or transparent material to let in the amount of light as desired, such as for a skylight or window. For example, roof material 508 may comprise a transparent material to provide views out through the top of structure 500.

As various changes could be made in the above constructions, products, and methods without departing from the scope of the invention, it is intended that all matter contained in the above description and shown in the accompanying drawings shall be interpreted as illustrative and not in a limiting sense. The invention, therefore, is not to be restricted except in the spirit of the appended claims.

What is claimed is:

1. A deployable structure including a structural mechanism comprising a plurality of structural members, a plurality of couplings and a plurality of tension lines, wherein each of said plurality of couplings interconnects three of said plurality of structural members and each of said plurality of tension lines interconnects one of said plurality of couplings and one of said plurality of structural members, wherein said structural mechanism defines a columnar space.

2. The deployable structure of claim 1 wherein each of said plurality of tension lines interconnects one of said plurality of couplings and one end of one of said plurality of structural members not interconnected with one of said plurality of couplings.

3. The deployable structure of claim 1 wherein said columnar space is centrally located within said structural mechanism.

4. The deployable structure of claim 1 wherein said columnar space is devoid of any structural members.

5. The deployable structure of claim 1 wherein, in the deployed structural mechanism, each of said couplings interconnects two of said three structural members such that they are substantially aligned along their respective longitudinal axes and the third of said three structural members is interconnected such that its longitudinal axis is substantially perpendicular to the longitudinal axes of said two structural members.

6. The deployable structure of claim 5 wherein, in a stowed condition of said structural mechanism, said two of said three structural members are no longer interconnected such that they are substantially aligned along their respective longitudinal axes.

7. The deployable structure of claim 1 wherein each of said couplings comprises a tube having first and second open ends wherein each of said first and second open ends receives an end of one of said two of said three structural members to interconnect said two structural members such that they are substantially aligned along their respective longitudinal axes when the deployable structure is deployed.

8. The deployable structure of claim 7 wherein an elastic cord is secured to each of said ends of said structural members received within said coupling.

9. The deployable structure of claim 8 wherein each of said couplings further comprises a stop member disposed within said tube between said first and second open ends to stop each of said ends of said structural members from traveling completely through said coupling and wherein said elastic cord passes through or around said stop member.

10. The deployable structure of claim 1 wherein, in a stowed condition, each of said couplings of said structural mechanism interconnects three of said structural members.

11. The deployable structure of claim 1 wherein said each of said structural members comprises a material selected from the group consisting of: plastic, aluminum, steel, metal, PVC tubing, wood, and graphite composite.

12. The deployable structure of claim 1 wherein each of said couplings is integral with at least one of said structural members.

13. The deployable structure of claim 1 wherein each of said couplings comprises a hinge which allows said structural mechanism to be converted from a deployed condition to a stowed condition and vice versa.

14. The deployable structure of claim 1 further comprising one or more tie lines, wherein each of said tie lines is disposed between one of said couplings and one of said structural members when the structural mechanism is deployed.

15. The deployable structure of claim 1 wherein said deployable structure is a tent and further comprises an outer covering acting as one or more components selected from the group consisting of: a roof, a floor, a side barrier and a wall.

16. The deployable structure of claim 15 wherein said tension lines are an integral part of said outer covering.

17. The deployable structure of claim 15 further comprising one or more tie lines, wherein each of said tie lines is disposed between one of said couplings and one of said structural members when the structural mechanism is deployed and wherein said tension lines and said tie lines are an integral part of said outer covering.

18. A method for assembling a deployable structure, comprising:

assembling a first subassembly comprising a first coupling removably interconnecting first and second structural members, a second coupling removably interconnecting third and fourth structural members, a first tension line removably attached to each of said first and third structural members, and a second tension line removably attached to each of said second and fourth structural members;

assembling a second subassembly comprising a third coupling removably interconnecting fifth and sixth structural members, a fourth coupling removably interconnecting seventh and eighth structural members, a third tension line removably attached to each of said fifth and seventh structural members, and a fourth tension line removably attached to each of said sixth and eighth structural members;

assembling a third subassembly comprising a fifth coupling removably interconnecting ninth and tenth structural members, a sixth coupling removably interconnecting eleventh and twelfth structural members, a fifth tension line removably attached to each of said ninth and eleventh structural members, and a sixth tension line removably attached to each of said tenth and twelfth structural members;

detaching said fifth tension line from said eleventh structural member;

removably attaching each of said fifth tension line and said eleventh structural member to said first coupling;

detaching said first tension line from said third structural member;

removably attaching each of said first tension line and said third structural member to said third coupling;

detaching said third tension line from said seventh structural member;

removably attaching each of said third tension line and said seventh structural member to said fifth coupling;

detaching said sixth tension line from said tenth structural member;

removably attaching each of said sixth tension line and said tenth structural member to said second coupling;

detaching said second tension line from said second structural member;

removably attaching each of said second tension line and said second structural member to said fourth coupling;

detaching said fourth tension line from said sixth structural member; and removably attaching each of said fourth tension line and said sixth structural member to said sixth coupling.

19. A deployable structure comprising six couplings, twelve structural members and six tension lines, wherein three of said structural members and one of said tension lines are removably attached to each of said couplings, wherein:

first, second and eleventh structural members of said twelve structural members and a fifth tension line of said six tension lines are removably attached to a first coupling of said six couplings;

third, fourth and tenth structural members of said twelve structural members and a sixth tension line of said six tension lines are removably attached to a second coupling of said six couplings;

third, fifth and sixth structural members of said twelve structural members and a first tension line of said six tension lines are removably attached to a third coupling of said six couplings;

second, seventh and eighth structural members of said twelve structural members and a second tension line of said six tension lines are removably attached to a fourth coupling of said six couplings;

seventh, ninth and tenth structural members of said twelve structural members and a third tension line of said six tension lines are removably attached to a fifth coupling of said six couplings; and sixth, eleventh and twelfth structural members of said twelve structural members and a fourth tension line of said six tension lines are removably attached to a sixth coupling of said six couplings;

said first tension line of said six tension lines is removably attached to said first structural member of said twelve structural members;

said second tension line of said six tension lines is removably attached to said fourth structural member of said twelve structural members;

said third tension line of said six tension lines is removably attached to said fifth structural member of said twelve structural members;

said fourth tension line of said six tension lines is removably attached to said eighth structural member of said twelve structural members;

said fifth tension line of said six tension lines is removably attached to said ninth structural member of said twelve structural members; and said sixth tension line of said six tension lines is removably attached to said twelfth structural member of said twelve structural members.

* * * * *